US006285326B1

(12) United States Patent
Diximus et al.

(10) Patent No.: US 6,285,326 B1
(45) Date of Patent: Sep. 4, 2001

(54) PATCH ANTENNA

(75) Inventors: Frédéric Diximus, Dole; Daniel Leclerc, Crissey, both of (FR)

(73) Assignee: Amphenol Socapex (FR)

( * ) Notice: Subject to any disclaimer, the term of this patent is extended or adjusted under 35 U.S.C. 154(b) by 0 days.

(21) Appl. No.: 09/581,143

(22) PCT Filed: Oct. 12, 1999

(86) PCT No.: PCT/FR99/02449

§ 371 Date: Jun. 9, 2000

§ 102(e) Date: Jun. 9, 2000

(87) PCT Pub. No.: WO00/22695

PCT Pub. Date: Apr. 20, 2000

(30) Foreign Application Priority Data

Oct. 12, 1998 (FR) ..... 98 12727

(51) Int. Cl.[7] ..... H01Q 1/38
(52) U.S. Cl. ..... 343/700 MS
(58) Field of Search ..... 343/700 MS; H01Q 1/38

(56) References Cited

U.S. PATENT DOCUMENTS

| | | | |
|---|---|---|---|
| 4,623,893 | 11/1986 | Sabban | 343/700 MS |
| 4,633,262 | 12/1986 | Traut | 343/700 MS |
| 4,697,189 | 9/1987 | Ness | 343/700 MS |
| 5,444,453 | 8/1995 | Lalezari | 343/700 MS |

OTHER PUBLICATIONS

Lee, Chon, et al., "Impedance Matching of a Dual–Frequency Microstrip Antenna with an Air Gap", IEEE Transactions on Antennas and Propagation, 41(1993) May, No. 5, New York.

Gauthier, Gildas P., et al., "Microstrip Antennas on Synthesized Low Dielectric–Constant Substrates", IEEE Transactions on Antennas and Propagation, vol. 45, No. 5 Aug. 1997.

Vaughan, Mark J., et al., "Improvement of Microstrip Patch Antenna Radiation Patterns", 8082 IEEE Transactions on Antennas and Propagation 42(1994) Jun., No. 6, New York US.

*Primary Examiner*—Michael C. Wimer
(74) *Attorney, Agent, or Firm*—Blank Rome Comisky & McCauley, LLP

(57) ABSTRACT

The invention relates to a microstrip antenna for transmitting and receiving waves of wave length λ. It comprises a first insulating plate and a first metallization effected on a face of said plate in order to form a ground plane; a second insulating plate and at least one second metallization effected on a face of said second plate and presenting dimensions smaller than those of the first metallization; at least one feedline connected to said first and second metallization; and spacer means fastened with the two plates in order to maintain the two plates in a predetermined relative position so that the two metallizations face each other and the second metallization is opposite the first.

6 Claims, 1 Drawing Sheet

PATCH ANTENNA

BACKGROUND OF THE INVENTION

1. Field of the Invention

The present invention relates to an antenna of the microstrip type for transmitting and receiving waves of wavelength λ belonging to the frequency band ranging from 100 Mhz to 6 Ghz and presenting in particular excellent transmission and reception characteristics in the 3.5 Ghz bands, the C band and S band.

2. Description of Related Art

Microstrip antennas are well known. They are most often constituted by a first metallic plate forming a ground plane and by one or more other metallic plates disposed opposite the ground plane and which constitute radiator patches. These two metallic plate/patch systems are most often fixed on the opposite faces of a block of dielectric material, thus ensuring in addition the mechanical connection between the ground plane and the radiator patch or patches.

However, such a system may become expensive, in particular due to the cost of the high-quality dielectric material when the radiator patch or patches present a relatively large surface area.

To overcome this drawback, it has been proposed to use as dielectric the air located between the ground plane and the radiator patch. In the case of a single radiator patch, this solution is already very delicate to implement insofar as it is difficult to hold the radiator patch in a precise position with respect to the ground plane and to ensure a mechanical connection between these two plates which can withstand outside stresses. This problem is rendered even more complex in the case of the radiating part of the antenna having to comprise a plurality of metallic patches since the latter must be maintained strictly in the same plane.

SUMMARY OF THE INVENTION

An object of the present invention is to provide a microstrip antenna using the air as dielectric material, while avoiding the drawbacks mentioned above, particularly concerning the mechanical structure of the antenna.

To that end, according to invention, the microstrip antenna for transmitting or receiving waves of wave-length λ is characterized in that it comprises:

- a first insulating plate and a first metallization effected on one face of said plate covering a part of said first plate to form a ground plane,
- a second insulating plate and at least a second metallization effected on one face of said second plate and presenting dimensions smaller than those of the first metallization, said second plate comprising a peripheral zone surrounding said second metallization over a width substantially equal to λ/10, corresponding to a region where the amplitude of the electromagnetic field created by the periphery of said second metallization is maximum, said second plate being provided with recesses in at least a part of said peripheral zone, solid portions separating said recesses in order to ensure a mechanical connection between that portion of said second plate bearing the second metallization and the rest of said second plate;
- at least one antenna feedline connected to said first and second metallizations, and
- spacer means fast with the two plates in order to maintain the two plates in a predetermined relative position so that the two metallizations face each other and the second metallization is opposite the first.

It will be understood that, thanks to the fact that the ground plane and the radiator patch or patches are disposed on insulating supports presenting a good mechanical strength and, moreover, the conducting plates are directly opposite one another, a microstrip antenna is obtained which may comprise one or more radiator patches which use the air as dielectric and which presents a suitable mechanical structure since the mechanical connection is easy via the insulating plates which serve as supports.

In addition, as will be explained in greater detail hereinbelow, the presence of the recesses in the plate surrounding at least a part of the metallizations forming the radiator patch or patches makes it possible effectively to use the air as dielectric in the maximum electronic field zone produced by the periphery of the radiating metallization or metallizations. In this way, optimal functioning of the antenna is obtained.

According to a preferred form of embodiment of the invention, the second insulating plate of the antenna is provided with a plurality of second metallizations of substantially rectangular form and the metallizations are electrically connected by connection portions.

In this embodiment which, thanks to the presence of the different radiating metallizations, makes it possible to suitably adapt the gain of the antenna, recesses are also provided in the peripheral zone disposed on either side of the means for electrical connection between the different radiating metallizations.

BRIEF DESCRIPTION OF THE FIGURES OF DRAWINGS

Other characteristics and advantages of the invention will appear more readily on reading the following description of several embodiments of the invention given by way of non-limiting examples. The description refers to the accompanying Figures in which.

Figure 1:
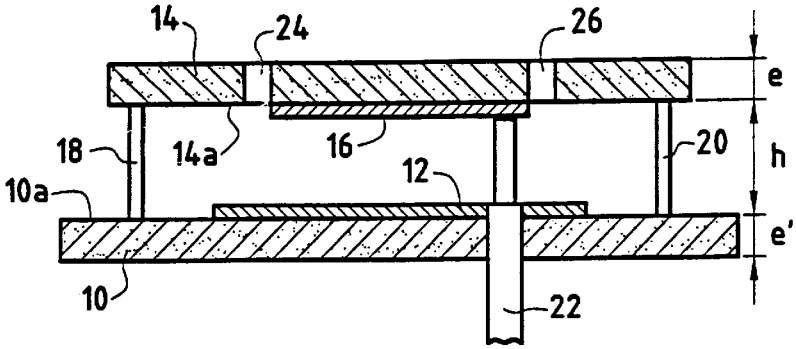
FIG. 1 is a view in vertical section of a first embodiment of the antenna in the case of it comprising only one radiating metallization.

Referring firstly to FIG. 1, a first embodiment of the microstrip antenna in the case of the radiating part being constituted by a single metallization, will be described.

DETAILED DESCRIPTION OF THE PREFERRED EMBODIMENT

Figure 2:
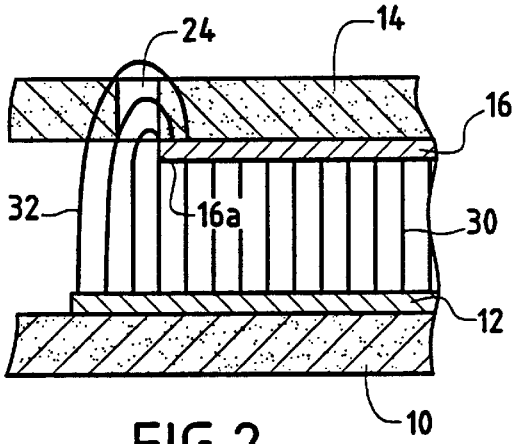
FIG. 2 is a view in detail of FIG. 1 showing the lines of electromagnetic fields between the ground plane and the radiating metallization.

The antenna comprises a first plate 10 made of insulating material of the type used for making printed circuits and whose thickness is preferably included between 0.8 and 1.6 millimeters in order to present sufficient mechanical properties. On the upper face 10*a* of this plate 10, there is effected a metallization 12 for example of copper in order to constitute the ground plane of the antenna. This metallization 12 is generally rectangular in shape. The antenna also comprises a second insulating plate 14 made with the same insulating material as the plate 10 and whose thickness e is of the same order of magnitude as that of the plate 10. On the lower face 14*a,* there is effected a metallization 16 by any suitable technique, constituting the radiator plate of the patch antenna. As is known, the metallization 16 is also rectangular in shape, the dimensions of which being adapted to the frequency band in which the antenna operates. Spaces such as 18 and 20 fixed in those parts of the insulating plates 10 and 14 not provided with metallization ensure a strict positioning of the two insulating plates and therefore of the ground plane 12 and the radiator patch 18. The antenna is completed by a feedline 22 which is connected respectively to the radiator patch 16 and to the ground plane 12, as is well known. Moreover, the insulating plate 14 is provided with recesses such as 24 and 26 disposed in a peripheral zone surrounding that portion of the insulating plate 14 covered by the metallization 16 for reasons which will be explained with reference to FIG. 2.

In this FIG. 2 are found again the insulating plate 10, the metallization 12, the insulating plate 14 and the metallization 16 forming radiator patch. This enlarged Figure shows the lines of electromagnetic field 30 which are developed between the conducting plates 12 and 16 in their opposite portion, as well as the lines of electromagnetic field 32 which are created by the electric current circulating on the periphery 16*a* of the metallization 16. As shown in the Figure, these lines of field in the maximum electromagnetic field zone created by this periphery 16*a* are firstly directed towards the insulating support 14. As this insulating support 14 is, for reasons of cost, made with a material having mediocre dielectric properties, the latter properties would reduce the quality of the antenna. For this reason, recesses 24 and 26 are made around the metallization 16, as will be explained in greater detail. In this way, the lines of electromagnetic field emitted by the periphery of the metallization 16 traverse the recesses 24 and 26 in which the dielectric is also constituted by air as is the case between the conducting plates 12 and 16. An antenna presenting very good qualities is thus obtained.

Figure 3:
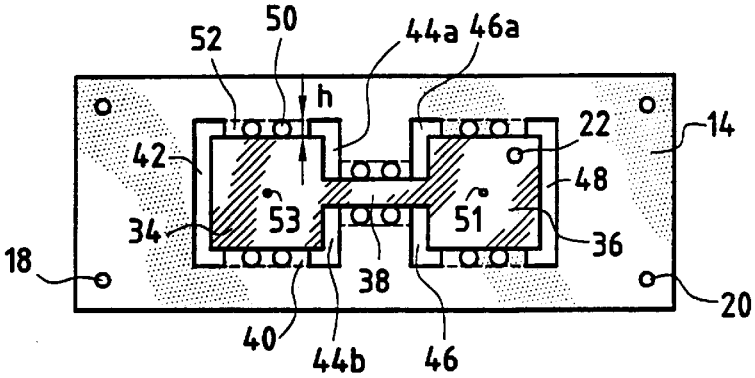
FIG. 3 is a view from underneath of the upper plate in the case of the latter comprising a plurality of radiating metallizations.
Figure 4:
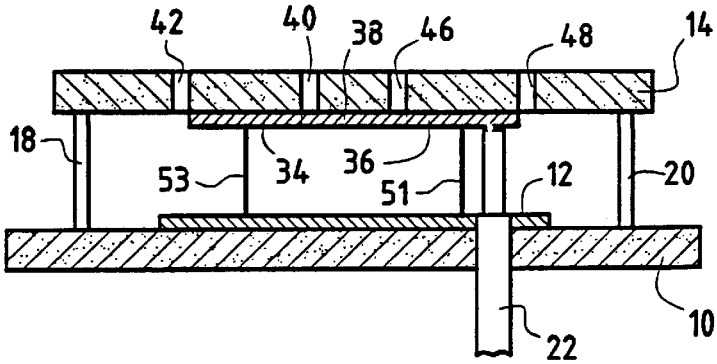
FIG. 4 is a view in vertical section of a microstrip antenna according to the invention comprising a plurality of radiating metallizations.

With reference now to FIGS. 3 and 4, a second embodiment of the antenna, in which the radiating part of the antenna is constituted by two metallizations, referenced 34 and 36 respectively, will be described. As is known, these two metallizations are substantially square in shape and their side corresponds to $\lambda/2$, $\lambda$ being the wave length in which the antenna operates. These two metallizations 34 and 36 are electrically connected together by an electrical connection portion 38 ensuring the electrical continuity between the metallizations 34 and 36. There is defined around the metallizations 34 and 36, as well as on each side of the connecting portion 38, a so-called peripheral zone 40 of which the width h is substantially equal to $\lambda/10$. It is inside this peripheral zone 40 that the recesses such as 24 and 26 are made. Of course, the recesses must occupy the highest possible percentage of the peripheral zone 40 while nonetheless ensuring a sufficient mechanical connection between the portions of the insulating plate 14 on which the metallizations are effected and the rest of this plate on which the spacers 18 and 20 are fixed. In priority, the material constituting the insulating plate must be removed where the amplitude of the electromagnetic field is maximum.

In order to make a compromise between a high percentage of recess in the peripheral zone 40 and the mechanical strength which must remain in this zone, the density of recesses will be increased along the edges of the conducting plates 34 and 36 corresponding to the presence of a maximum magnetic field and this density will be decreased along the other edges and along the edges of the electrical connection 38. For example, in the case of FIG. 3, there are provided in this peripheral zone 40 slots 42, 44*a,* 44*b,* 46*a,* 46*b* and 48 which correspond to the whole width of the conducting plates. On the other hand, on the other two edges of each of the two metallizations, there will simply be provided spaced apart recesses such as 50, for example circular in shape, separated by portions of the insulating material 52 ensuring mechanical continuity of the whole of the plate.

As also shown in FIGS. 3 and 4, it may be advantageous to provide short-circuit wires such as 51 and 53 which respectively connect the ground plane 12 to each of the metallizations 34 and 36 substantially at its centre. In this way, a substantially zero electric potential is set at the centre of each of the radiator patches 34 and 36, which improves stability of the antenna.

Figure 5:
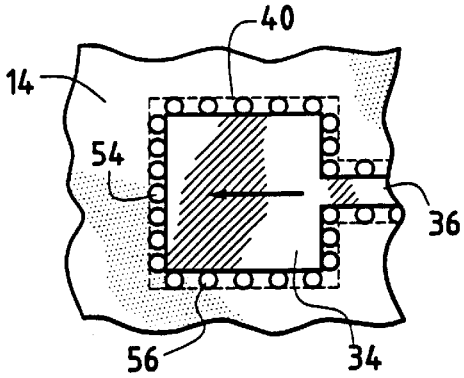
FIG. 5 is a partial view of FIG. 3 showing a variant embodiment of the recesses surrounding the radiating metallizations.

FIG. 5 shows a variant embodiment of the recesses inside the peripheral zone 40. This Figure simply shows the metallization 34 and the beginning of the electrical connection portion 38. In those parts of the peripheral zone 40 corresponding to the maximum electromagnetic field, recesses 54, for example circular, which are very close to one another are found, while, along the other two edges of the plate, likewise circular recesses 56 are found which are more spaced apart from one another, so that, overall, the mechanical strength is obtained ad hoc.

It goes without saying that the invention would not be exceeded if the radiating part of the antenna were constituted by more than two conducting plates electrically connected together. Neither would the invention be exceeded if the conducting plates forming the radiating part of the antenna were not connected electrically, but each comprised an antenna line such as 22. Finally, it should be noted that, in order to obtain both the rate of vacuum around the radiating conductor elements and the sufficient mechanical strength, one may also play on the dimensions of the elementary recesses 54 or 56.

Similarly, in the foregoing description, the radiating plates are rectangular or square. However, it goes without saying that the invention would not be exceeded if these metallizations were in the form of a circle, polygon, etc.

What is claimed is:

1. Microstrip antenna for transmitting or receiving waves of wave-length $\lambda$ comprising:

a first insulating plate and a first metallization effected on one face of said plate covering a part of said first plate to form a ground plane, a second insulating plate and at least a second metallization effected on one face of said second plate and presenting dimensions smaller than those of the first metallization, said second plate comprising a peripheral zone surrounding said second metallization over a width substantially equal to $\lambda/10$, corresponding to a region where the amplitude of the electromagnetic field created by the periphery of said second metallization is maximum, said second plate being provided with recesses in at least a part of said peripheral zone, solid portions separating said recesses in order to ensure a mechanical connection between that portion of said second plate bearing the second metallization and the rest of said second plate;

at least one feedline connected to said first and second metallizations, and spacer means fastened with the two plates in order to maintain the two plates in a predetermined relative position so that the two metallizations face each other and the second metallization is opposite the first.

2. Antenna according to claim 1, wherein said second plate is provided with a plurality of second metallizations of substantially rectangular shape and in that said metallizations are electrically connected by feedlines forming connection portions.

3. Antenna according to claim 2, wherein said second metallization is substantially surrounded b a peripheral zone and in that each connection portion is bordered by a peripheral zone, recesses being arranged in at least a part of each peripheral zone.

4. Antenna according to claim 2, wherein for each second metallization, the recesses comprise a slot arranged over the whole length of two parallel sides of the same metallization.

5. Antenna according to claim 1, wherein said recesses comprise circular bores.

6. Antenna according to claim 1, wherein it further comprises short-circuit lines, each short-circuit line connecting said first metallization to the center of a second metallization.

* * * * *